US010774559B2

(12) United States Patent
Newberry

(10) Patent No.: US 10,774,559 B2
(45) Date of Patent: Sep. 15, 2020

(54) BREAK RESISTANT UTILITY POLE DESIGN

(71) Applicant: Eric Newberry, Englewood, TN (US)

(72) Inventor: Eric Newberry, Englewood, TN (US)

( * ) Notice: Subject to any disclaimer, the term of this patent is extended or adjusted under 35 U.S.C. 154(b) by 0 days.

(21) Appl. No.: 16/377,985

(22) Filed: Apr. 8, 2019

(65) Prior Publication Data

US 2019/0368217 A1 Dec. 5, 2019

Related U.S. Application Data

(60) Provisional application No. 62/680,810, filed on Jun. 5, 2018.

(51) Int. Cl.

| | |
|---|---|
| ***E04H 12/18*** | (2006.01) |
| ***E04H 9/14*** | (2006.01) |
| ***E04H 12/34*** | (2006.01) |

(52) U.S. Cl.

CPC ..... *E04H 12/187* (2013.01); *E04H 9/14* (2013.01); *E04H 12/345* (2013.01)

(58) Field of Classification Search

CPC ..... E04H 12/187; E04H 9/14; E04H 12/345; E04H 12/24

See application file for complete search history.

(56) References Cited

U.S. PATENT DOCUMENTS

| | | | | |
|---|---|---|---|---|
| 5,116,064 | A * | 5/1992 | Corlett | F41J 7/04 404/10 |
| 2004/0221543 | A1* | 11/2004 | Eleas | E04H 12/187 52/153 |
| 2010/0272505 | A1* | 10/2010 | Daniel | E04H 12/187 403/306 |

* cited by examiner

*Primary Examiner* — Patrick J Maestri

(74) *Attorney, Agent, or Firm* — Stephen J. Stark; Miller & Martin PLLC

(57) ABSTRACT

A utility pole is resistant to breakage by providing a connection between an upper and a lower portion. In many embodiments, the upper portion with an arm supporting a utility line is able to deflect relative to a lower portion at the connection and then either be replaced or restored to the upright configuration.

13 Claims, 6 Drawing Sheets

BREAK RESISTANT UTILITY POLE DESIGN

CLAIM OF PRIORITY

This application claims the benefit of U.S. Provisional Application No. 62/680,810 filed Jun. 5, 2018, which is incorporated by reference herein in its entirety.

FIELD OF THE INVENTION

The present invention relates to a break resistant utility pole design. More particularly, the present invention relates to a utility pole whether it be a spun concrete pole, a tower, a wood pole or a metal pole having at least two segments whereby one of the segments has a normal installation configuration relative to the other, and at least one, if not a plurality, of deflected configurations whereby the first segment moves toward a desired position, normally off-axis relative to the second segment, and then, the first segment can preferably be restored to its normal installation configuration.

BACKGROUND OF THE INVENTION

Utility poles, whether they be monopoles or multi-leg towers, are traditionally relatively expensive to install. Utility poles can be used for power distribution, transmissions, lighting, communications and many other functions. Costs exceeding a million dollars per mile for transmission pole lines is common in the industry.

In the event of an accident and/or a disaster such as a tornado or hurricane, it is likely that at least one pole may be compromised (i.e., broken) which then can assist in pulling down multiple poles thereby creating not only a dangerous situation with the potential of having electric lines live on the ground, but also typically requires complete replacement of the affected poles.

Accordingly, a need exists to provide an improved pole construction capable of withstanding what has traditionally been a severe event (i.e., a need to bend, but not break).

SUMMARY OF THE INVENTION

It is a present object of many embodiments of the present invention to provide an improved utility pole having a traditional upright configuration and a deflected condition whereby when in the deflected condition the pole can be restored to its traditional upright configuration.

It is another object of many embodiments of the present invention to provide a utility pole having an upright configuration and at least one, if not a plurality, of deflected positions preferably having a resistance mechanism applying a selected resistance between the upright and the deflected condition.

It is another object of many embodiments of the present invention to provide an improved utility pole construction having an upright configuration as well as at least if not a plurality of deflected configurations whereby the pole can transition from the upright to the deflected condition without breaking the pole, thereby allowing the pole to be returned to the upright configuration.

It is another object of many embodiments of the present invention to provide an improved utility pole having at least one ball and socket junction or connection between first and second configurations whereby the connection is locked preferably with an upper portion in an upright configuration supporting utility lines thereon and a lower portion directed towards a foundation supporting the utility pole. Under extreme conditions the upper portion can rotate, twist, move, or at least pivot relative to the bottom portion to a deflected configuration. In a restoration process, the upper portion can be returned to the upright configuration.

It is another object of many embodiments of the present invention to provide a first and second utility pole portions having a ball and socket connection there between under resistance whereby the upper portion of the utility pole is normally in the upright configuration and upon a severe event (like a severe wind event) the upper portion deflects relative to the bottom portion and then can be rotatedly returned to the upright configuration without the pole breaking, and in many embodiments, while simultaneously keeping insulators, cross-arms, lighting fixtures, and electrical wires off the ground during the severe event.

Accordingly, in accordance with a presently preferred embodiment of the present invention, a utility pole provides an upper portion and a lower portion connected by at least one connection. In many embodiments, the connection is a ball and socket connection whereby one portion can rotate relative to the other portion between upright and deflected condition such as could be preferably between 30% and/or roughly at least 60%, potentially up to 90 degrees, whereby insulators in an upper portion are preferably maintained above the ground together with any electrical wires thereon when in the deflected or maximum deflected configuration. Resistance members such as resistance pads can apply a desired amount of tension can be used to provide at least one predetermined resistance (but before a failure condition exists) whereby a specific force may be applied to allow the first portion to move relative to the second portion. Additionally, limiters in one or more of a variety of configurations may be provided in a variety of different embodiments to limit the maximum amount of movement to a maximum deflected configuration relative to the upright configuration.

Although monopoles are a presently preferred embodiment, possibly with a single joint connection therebetween, it is also possible for some embodiments to provide for multiple connections on a monopole or even for tower constructions having a somewhat similar construction in that each of multiple feet may be provided with multiple connections so as to permit a tower to deflect under a severe event (normally wind related) as well, while still possibly maintaining the insulators and electrical wires suspended above the ground during a maximum deflected configuration.

Severe events anticipated are events which may otherwise cause the poles to reach a failure load such as hurricanes, tornadoes, structures falling on utility lines, or other such events and thereby allow the resistance setting(s) on the connection to permit deflection before a failure stress is achieved on the pole. When in the deflected configuration, it may be possible to at least partially release some of the resistance applied at the connection(s) and then return the utility pole or tower to the upright configuration with a crane or other device to then be able to eventually restore power thereto without having to replace many, if any, portions of the tower.

Even if the upper portion does fail in some embodiments and/or potentially crash to the ground, then for at least in such embodiments, only the upper portion of the pole may need be replaced thereby eliminating a need to dig a new foundation as at least a portion of the pole with the foundation can remain in place, thereby significantly decreasing the cost of pole replacement in the field after severe conditions and even catastrophic conditions.

Still other embodiments may provide even additional benefits.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
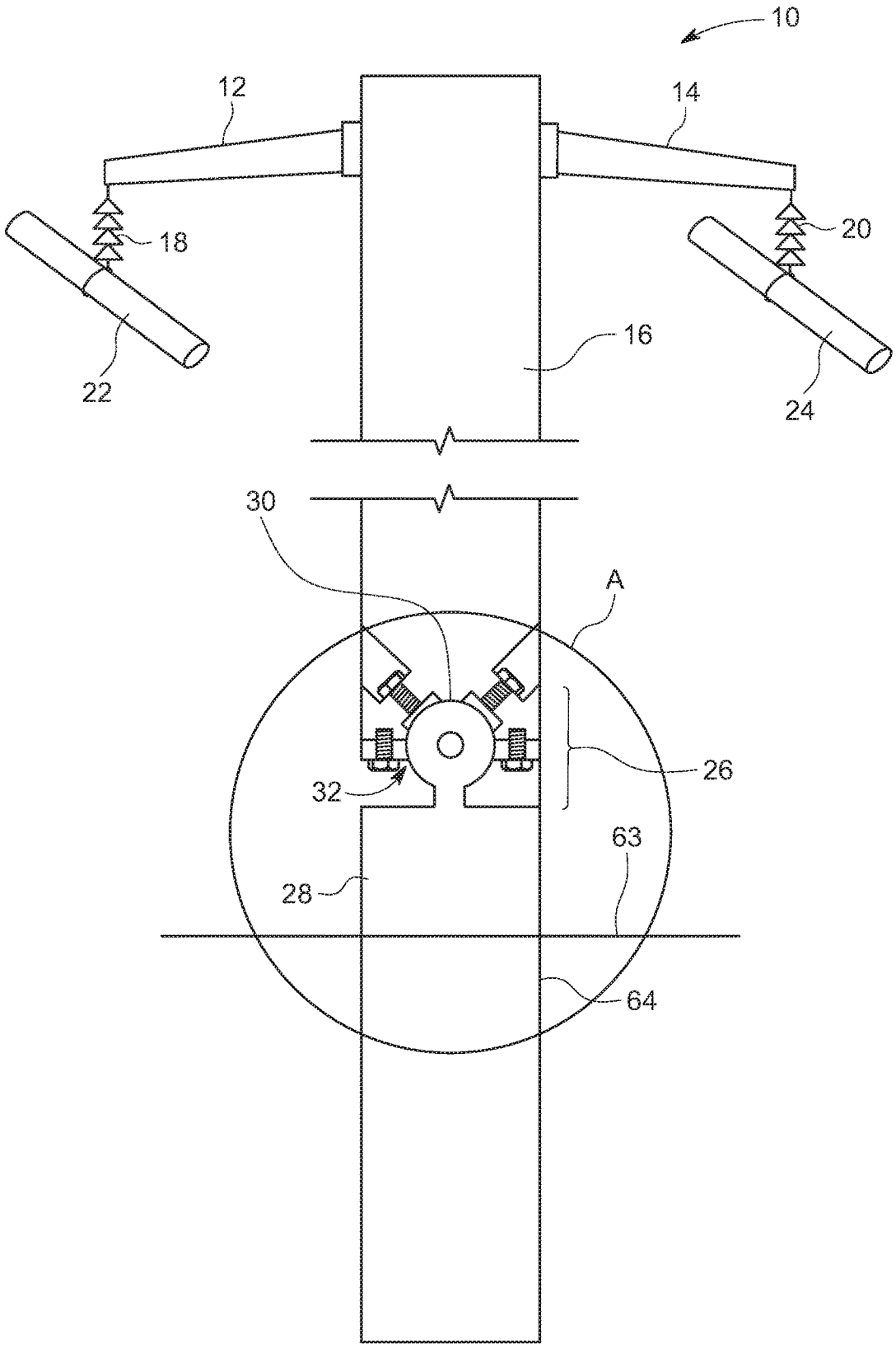
FIG. 1 is a perspective cutaway view of a utility pole constructed in the presently preferred embodiment of the present invention.

FIG. 1 is a utility pole 10 constructed in accordance with the presently preferred embodiment of the present invention. Specifically, pole 10 may have one or more arms 12, 14, whether they be symmetrical or not symmetrically around about upper pole portion 16 or not. From the often cantileveredly, or outwardly, extending arms 12, 14, are typically located one or more insulators 18, 20, from which one or more utility lines 22, 24 are supported, whether they be electric power lines, fiberoptic lines, cable lines, or other utility lines provided thereon.

The upper portion 16 of the utility pole 10 can take any similar construction as illustrated or as provided in the prior art.

The utility pole upper portion 16 could be made of spun concrete, metal, wood, or other appropriate material or materials as could a second or lower portion 28 discussed below. The pole can be a distribution, transmission, lighting pole, communications, or any pole design.

The upper portion 16 preferably terminates at connection 26, which could be a first connection, to which the upper portion 16 connects to a lower portion 28. The connection 26 can take more than one constructions but is preferably designed so as to facilitate movement between a first configuration shown as an upright configuration illustrated in FIG. 1 and FIG. 4 and a deflected configuration such as that shown in FIG. 2 and FIG. 3. More than one connection 26 could be provided for some poles 10 or towers as discussed below.

For at least some embodiments, connection 26 may consist of a ball 30 and socket 32 connection to provide a pivotable connection and/or hinged connection. Other connections could include other pivots, hinges or other suitable connections which would permit the ability to provide a utility pole 10 having an upright configuration shown in FIG. 1 and a deflected configuration as will be described in further detail below provided, preferably with an ability to be able to restore or possibly replace the upper portion 16 of the pole 10 to the upright configuration should a situation occur as will be described in further detail below.

Figure 2:
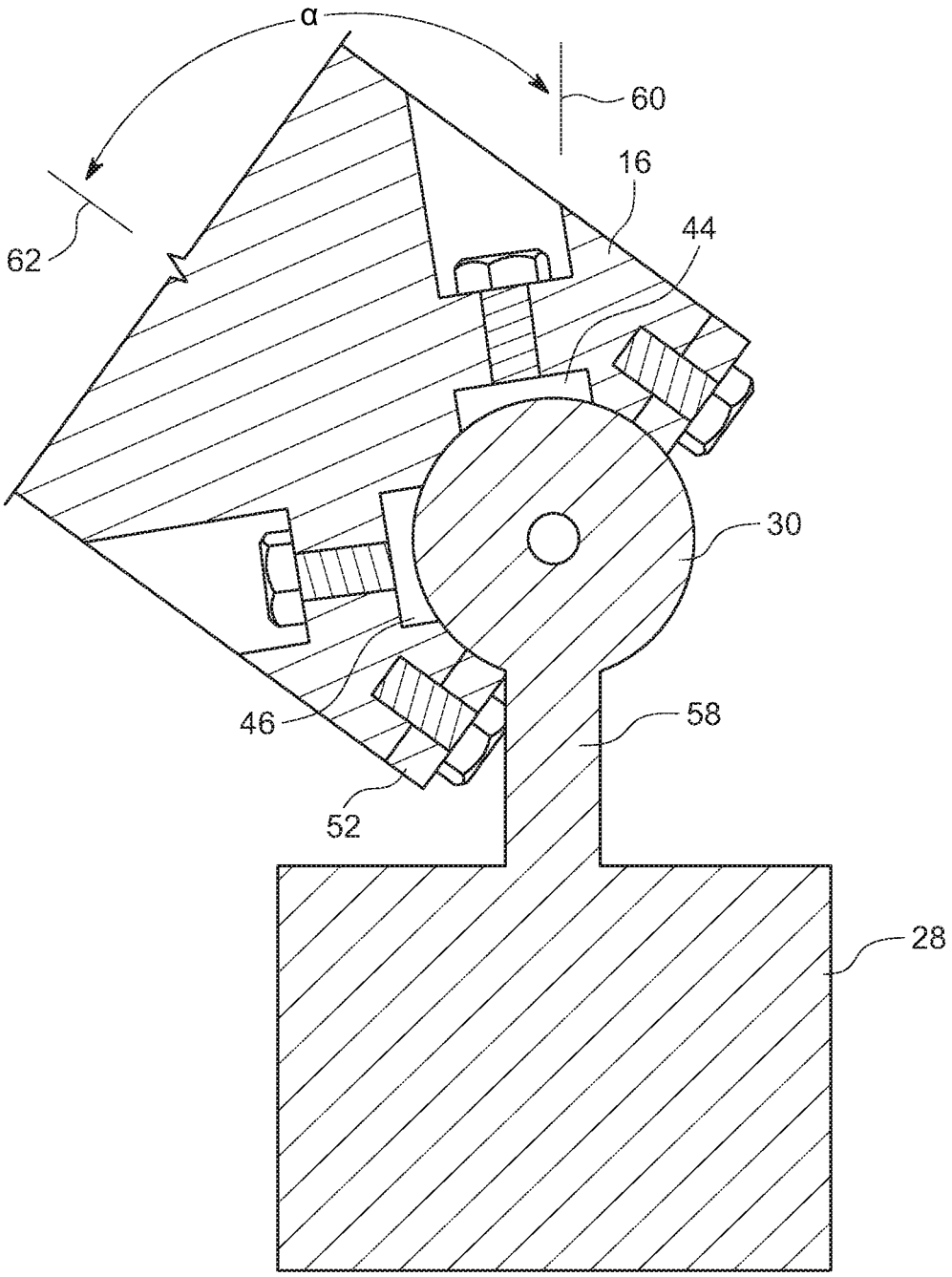
FIG. 2 is a cross section detail view of detail A in FIG. 1 in a deflected configuration.
Figure 3:
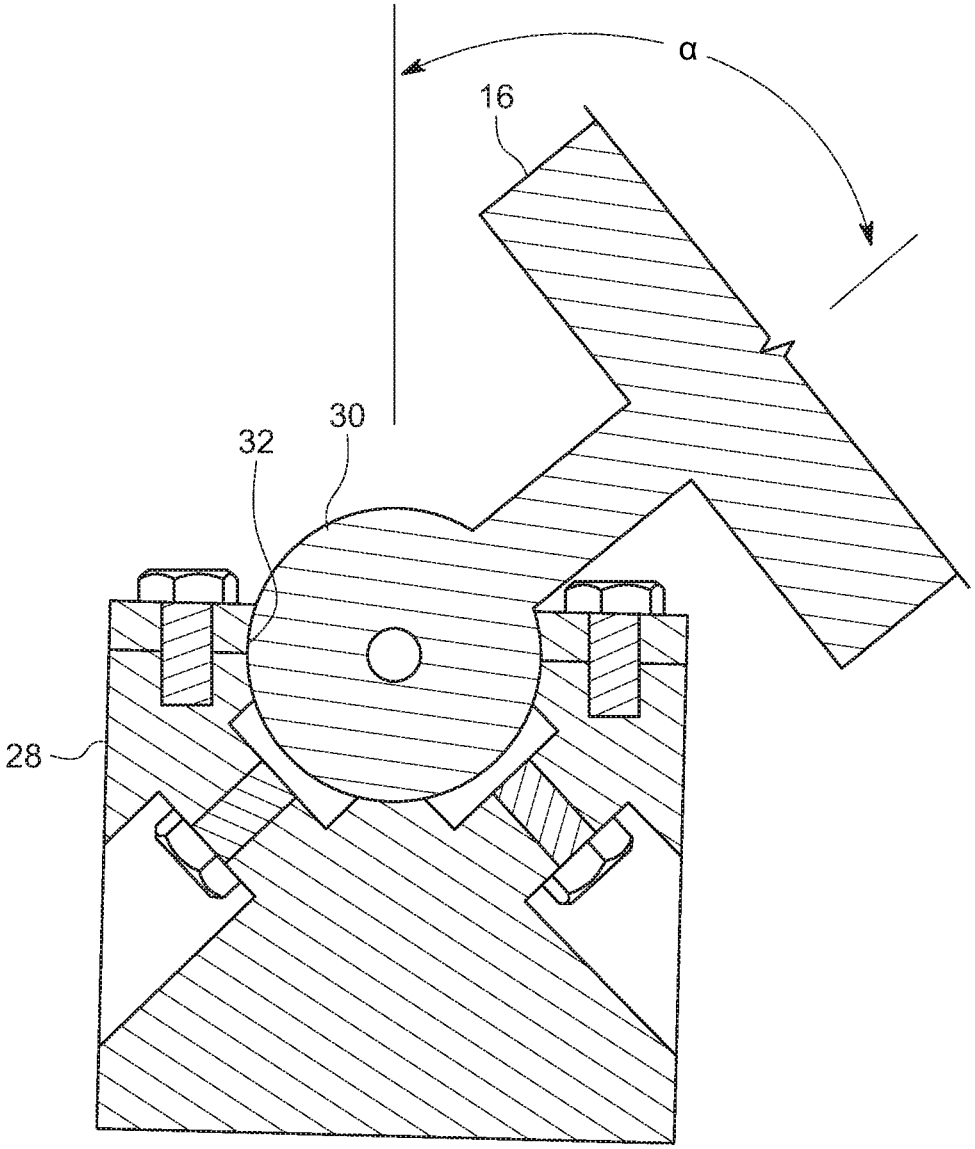
FIG. 3 is a cross section detail view of detain A in a first alternative preferred embodiment of the present invention.
Figure 4:
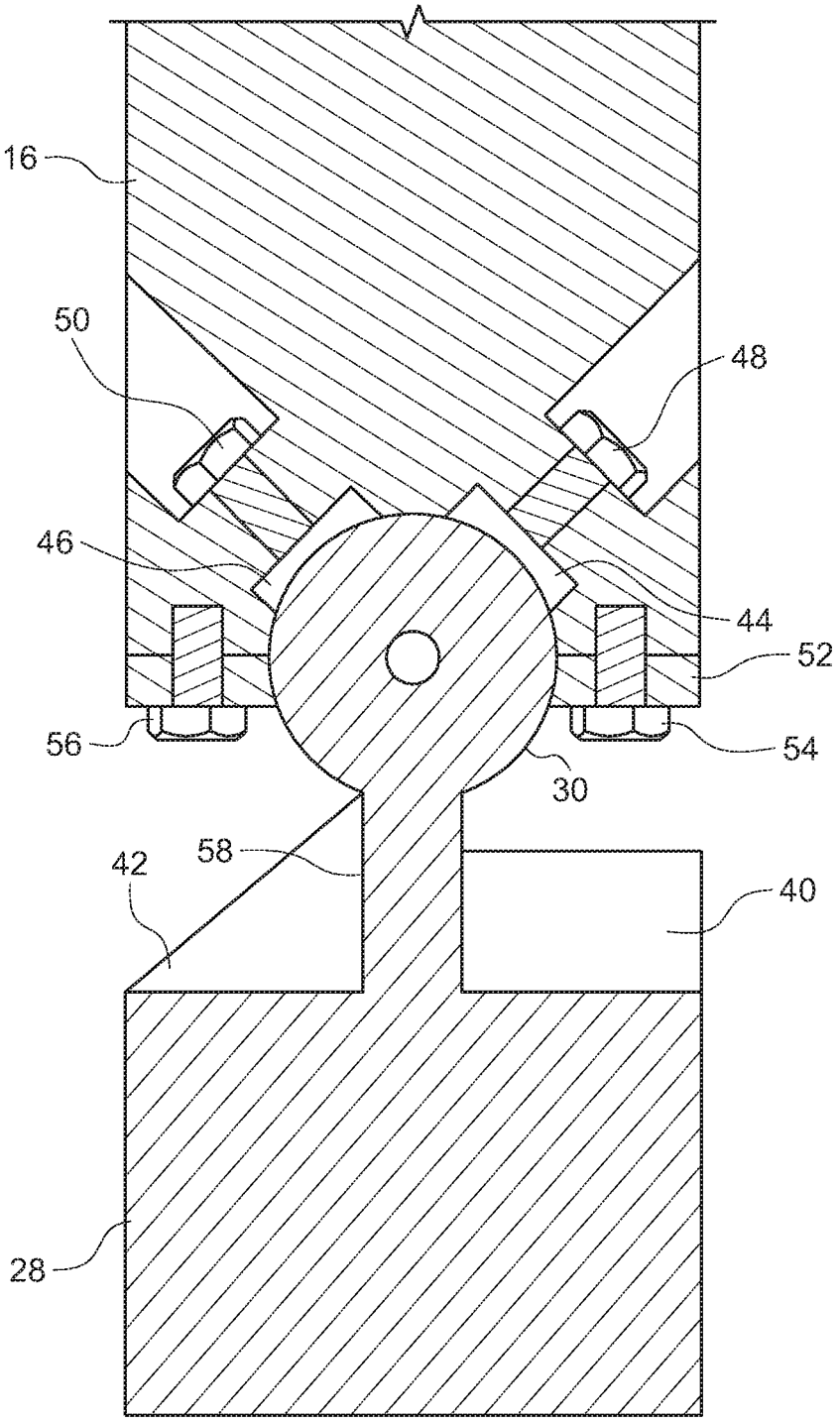
FIG. 4 is cross section detail view of detail A in FIGS. 1 and 2 in an upright configuration showing at least two potential embodiments of limiters apart from the connection itself.
Figure 5:
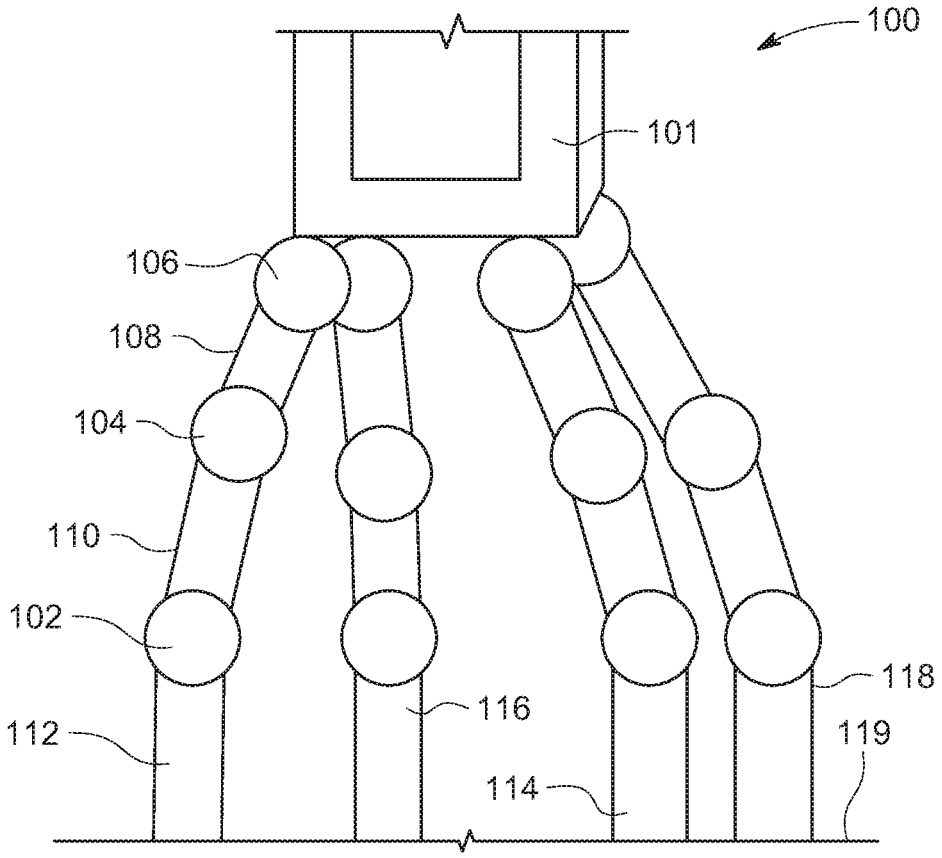
FIG. 5 is a diagramic view of a third alternative preferred embodiment of a tower utilizing technology shown on FIG. 1 of the present invention in an upright configuration.

FIG. 4 shows a first or upper portion 16 connected to a second or lower portion 28. Which portion 16,28 is the upper or lower could be selected by the user as shown in FIGS. 2 and 3. FIG. 4 shows an upright configuration with at least two limiters 40, 42 which may or may not be utilized for various embodiments to potentially limit the deflection potentially a predetermined amount so that the utility line(s) 22,24 along with the arm(s) 12,14 and/or upper portion 16 do not contact the ground 63 at a maximum deflected condition. Other limiters of various constructions could be utilized with other embodiments.

FIG. 4 is also useful to show that a construction of one or more resistance members 44, 46 which may or may not have the same resistance value against the ball 30. Specifically, in this embodiment, bolts 48 and 50, of which two are illustrated (which easily could be more depending on the configuration of the particular embodiment such as two toward a front and two toward a back or even more). Furthermore, any or all of the resistance members 44, 46 could have the same or different applied resistance against the ball 30 or other structure and could be constructed so that the resistance experienced by the upper portion 16 due to a severe event such as a wind, loading or pulling by the utility line(s) (such as if a structure fell on utility line or an adjacent pole fell) could have the upper portion 16 move relative to the lower portion 18 rather than the utility pole 10 break as has been experienced in the prior art. Resistance to the various resistance members 44, 46 can be appropriately set to achieve this objective.

In order to install the upper portion 16 on the lower portion 28, it may be desirable to have one or more retaining plates 52 which could be constructed in any number of ways Retaining plate 52 may be connection to the first portion 16 to assist in securing the first portion 16 to the ball 30. Resistance plate 52 could be connected with a series of bolts 54, 56 and/or other connection system, particularly if a different connection is utilized rather than a ball 30 and socket 32 connection.

While the socket 32 is shown connected to the upper portion 16, it could be ball 30 is connected to the lower portion 28. The embodiment of FIG. 4 shows a post 58 supporting the ball 30. It is also possible to provide constructions such as those shown in FIG. 2 or 3 where the ball 30 is connected to the upper portion 16 and the socket 32 is a portion of the lower portion 28. More will be discussed about this embodiment below.

FIG. 2 shows the embodiments of FIGS. 1 and 4, namely the ball 30 is connected to the lower portion 28. In this embodiment, a severe event as could occur in a tornado or hurricane, a typhoon, or other events such as even a failure of an adjacent pole thereby pulling the utility lines, thereby pulling the adjacent pole and subsequent adjacent poles over or off of an upright position. This would normally break many poles. However, the Applicant's pole 10 can deflect up to the maximum deflected configuration shown in FIG. 2 from upper portion 16 is angled at alpha angle ($\alpha$) from the vertical configuration along axis 60 towards maximum deflection of the axis 62 which could be limited by the plate 52 or bolt 54 contacting the post 58 in the illustrated embodiment. This is one type of limiter. There are other types of limiters such as limiters 40 and 42 which could cause angle alpha ($\alpha$) to be smaller than that shown in FIG. 2. Alpha might be roughly about 30 degrees such as could be provided by the limiter 42 or even 75 degrees as provided by limiter 40 or other appropriate angle down to roughly 60 degrees as is shown in FIG. 2 to even further than 60 degrees, but preferably high enough to maintain the insulators 18, 20 spaced off of the ground in a maximum deflected configuration preferably along with the utility lines 22, 24, arms 12,14 and/or upper pole portion 16. The amount of resistance applied by the resistance pads 44, 46 could potentially increase towards the maximum deflected configuration and/or be variable between the upright configuration and the maximum deflected configuration, and could possibly cause the upper portion 16 to stop at any angle therebetween depending upon the particular severe event experienced.

The resistance members 44, 46 are preferably designed so that the upper portion 16 rotates or otherwise moves relative to the lower portion 28 in a controlled manner so that once the severe event has finished, the upper portion 16 can relatively be quickly returned to the upright configuration as shown in FIG. 1 if not completely damaged beyond salvageability. For some embodiments, the bolts 48, 50 could be loosened and possibly others such as 54 and 56 may also need to be loosened so that the first portion 16 could then be returned to the configuration shown in FIG. 1 such as with a crane, a boom, or other appropriate structure, and then the appropriate amount of tension reapplied to the rear pads 44, 46, if not the flange 52 as well.

Under some severe conditions may be so severe that it is possible that the upper portion 16 may break relative to the lower portion 28 and in such embodiments, it may be possible that a need to exist only to replace the upper portion 16 rather than the lower portion 28 as well which thereby prevents a need to replace the under ground 63 portion 64 which could result in a significant savings in time, materials, and labor to the utility company by only replacing upper portion 16 when reattaching the lines 22, 24, etc.

Figure 6:
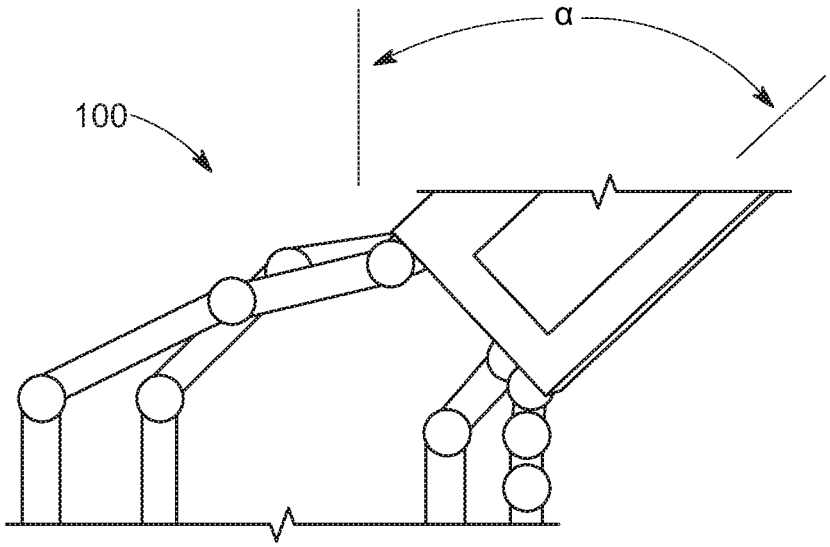
FIG. 6 is a diagramic view of the structure as shown in FIG. 5 in a deflected configuration.

While the utility poles 10 are the present preferred embodiments of the invention, it is also possible that towers such as tower 100 could be constructed in a somewhat similar manner probably having at least two or maybe three or more connections per leg 112,114,116,118 connected to upper portion 101 to provide a utility line support which could be a tower 100 or a pole 10. Upper portion 101 may be similar (or not) to upper portion 16 of FIGS. 2 and 4. A tower 100 could have multiple legs 112,118 in the ground 119, possibly having at least three connections with at least two intermediate segments 108 and 110. Two or three connections 102, 104, and 106 are illustrated on each of at least two or even at least three if not four legs if utilized. It may be understood that only two connections 102, 104 might be necessary if for other embodiments. From FIG. 6 after a severe event, angle alpha ($\alpha$) may be achieved based on the length and construction of the connections 102, 104, and 106 which may be similar to those of Detail A of FIG. 1 as would be understood by those of ordinary skill in the art to a maximum deflected configuration. Tower 100 of FIG. 6 has a maximum deflection of alpha based on that construction and transitioning to angles up to alpha could occur as they could with the embodiments of FIGS. 1-4 under severe events. This construction could possibly be advantageous for large transmission lines.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. The utility line support comprising:

one of a tower and a pole having an upper portion with at least one outwardly extending arm for supporting at least one utility line therefrom;

a lower pole portion with a connector intermediate the upper portion and the lower pole portion, said lower pole portion connected to ground;

an upright configuration and a deflected configuration, wherein when in the upright configuration, the upper portion extends upwardly until subjected to at least a predetermined force, and when in the deflected configuration, the upper portion is angled relative to vertical while maintaining the arm and the upper portion above the ground; and when in the deflected configuration, the upper portion is one of replaced and restored to the upright configuration at the connection;

at least one resistance member providing a predetermined force against a ball in the upright configuration; and a bolt assisting in providing the predetermined force in the upright configuration.

2. The utility line support of claim 1 wherein the bolt is loosened to restore the utility line support to the upright configuration from the deflected configuration and then a desired amount of force is applied through the bolt to the resistance member in the upright configuration.

3. The utility line support of claim 1 wherein the at least one resistance member is a pad contacting the ball.

4. A method of restoring power to a utility line comprising the steps of:

a) providing one of a tower and a pole having an upper portion with at least one outwardly extending arm supporting at least one energized utility line therefrom;

a lower pole portion with a connector intermediate the upper portion and the lower pole portion, said lower pole portion connected to ground;

an upright configuration and a deflected configuration, wherein when in the upright configuration, the upper portion extends upwardly until subjected to at least a predetermined force, and when subjected to at least the predetermined force, transitioning to the deflected configuration with the upper portion angled relative to vertical while maintaining the arm and the upper portion spaced above the ground; and subjecting the one of the tower and the pole to one of an accident and a disaster which forces the upper portion to the deflected condition;

when in the deflected configuration, one of replacing and restoring the upper portion to the upright configuration at the connection.

5. The method of claim 4 wherein the upper portion is pivotably connected to the lower pole portion at the connection and the upper portion pivots to provide the deflected configuration.

6. The method claim 5 wherein the upper portion is hingedly connected to the lower pole portion at the connection and the upper portion pivots to provide the deflected configuration.

7. The methods of claim 5 wherein the connection further comprises a ball connected to a first of the upper portion and the lower pole portion.

8. The method of claim 7 wherein the connection further comprises a socket connected to a second of the upper portion and the lower portion.

9. The method of claim 7 further comprising at least one resistance member providing a predetermined force against the ball in the upright configuration.

10. A method of restoring power to a utility line comprising the steps of:

a) providing one of a tower and a pole having an upper portion with at least one outwardly extending arm supporting at least one utility line therefrom;

a lower pole portion with a connector intermediate the upper portion and the lower pole portion, said lower pole portion connected to ground;

a ball connected to a first of the upper portion and the lower pole portion;

an upright configuration and a deflected configuration, wherein when in the upright configuration, the upper portion extends upwardly until subjected to at least a predetermined force, and when subjected to at least the predetermined force, transitioning to the deflected configuration with the upper portion angled relative to vertical while maintaining the arm and the upper portion spaced above the ground, at least one resistance member providing a predetermined force against the ball in the upright configuration, and a bolt assisting in providing the predetermined force in the upright configuration; and when in the deflected configuration, one of replacing and restoring the upper portion to the upright configuration at, the connection.

11. The utility line support of claim 10 further comprising the step of loosening the bolt to restore the utility line support to the upright configuration from the deflected configuration and then applying a desired amount of force through the bolt to the resistance member in the upright configuration.

12. The utility line support of claim 10 wherein the at least one resistance member is a pad contacting the ball.

13. The utility line support of claim 4 further comprising a limiter connected to the support preventing the upper portion and the arm from contacting the ground in a maximum deflected configuration.

* * * * *